US009516952B2

(12) United States Patent
Rohr et al.

(10) Patent No.: US 9,516,952 B2
(45) Date of Patent: Dec. 13, 2016

(54) MATTRESS BUCKET RETENTION MECHANISM

(71) Applicant: L&P PROPERTY MANAGEMENT COMPANY, South Gate, CA (US)

(72) Inventors: William Rohr, Joplin, MO (US); Christopher John Schnake, Carthage, MO (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 14/743,413

(22) Filed: Jun. 18, 2015

(65) Prior Publication Data

US 2015/0366363 A1 Dec. 24, 2015

Related U.S. Application Data

(60) Provisional application No. 62/015,397, filed on Jun. 21, 2014.

(51) Int. Cl.
*A47C 21/02* (2006.01)
*A47C 31/10* (2006.01)

(52) U.S. Cl.
CPC ..... *A47C 21/026* (2013.01); *A47C 31/105* (2013.01)

(58) Field of Classification Search
CPC ..... A61G 7/002; A61G 7/015; A61G 13/02; A61G 13/08; A47G 9/0238; A47G 9/0246; A47G 9/02; A47C 31/105; A47C 31/00; A47C 21/022; A47C 21/026
USPC ..... 5/613, 600, 411, 692, 722, 723, 737, 5/613, 738,5/740, 496, 497, 498, 499, 482
See application file for complete search history.

(56) References Cited

U.S. PATENT DOCUMENTS 206,980 A * 8/1878 Squires ..... A47C 21/026 5/201
539,607 A * 5/1895 Boyd ..... A47C 21/026 5/411
1,842,873 A * 1/1932 Leeking ..... A47C 21/026 5/411
1,927,109 A * 9/1933 Abrams ..... A47C 21/026 5/187
2,119,706 A * 6/1938 Drexler ..... A47C 27/0456 5/692
2,588,854 A * 3/1952 Lang ..... A61G 7/015 5/411
2,907,055 A * 10/1959 Berman ..... A47C 31/105 5/496

(Continued)

*Primary Examiner* — Robert G Santos
(74) *Attorney, Agent, or Firm* — Shook, Hardy & Bacon L.L.P.

(57) ABSTRACT

A mattress bucket retention mechanism and device for securing a mattress on an automated bed is provided. Embodiments of the invention relate to an integrated mattress bucket retention mechanism for an adjustable bed. In one embodiment, the mattress bucket retention mechanism secures a mattress against articulating deckboard panels of an adjustable bed. In other embodiments, the mattress bucket retention mechanism provides a replaceable top surface for covering a mattress. Further, the mattress bucket retention mechanism may serve as a protective surround for the mattress. Embodiments of the mattress bucket retention mechanism include a deckboard having a deckboard edge, a mattress wrap having side panels and a top panel, and a zipper closure mechanism, which are used to create an interior compartment for securing a mattress.

19 Claims, 2 Drawing Sheets

(56) References Cited

U.S. PATENT DOCUMENTS

| | | | | | |
|---|---|---|---|---|---|
| 2,995,762 | A * | 8/1961 | Albinson | A47C 23/00 | 5/133 |
| 3,837,020 | A * | 9/1974 | Bosch | A47C 21/026 | 5/411 |
| 3,846,857 | A * | 11/1974 | Weinstock | A47C 27/15 | 5/722 |
| 4,726,083 | A * | 2/1988 | Hoshall | A47C 21/026 | 297/DIG. 6 |
| 7,188,379 | B2 * | 3/2007 | James | A47C 27/081 | 5/12.1 |
| 8,683,627 | B2 | 4/2014 | Rippe et al. | | |
| 8,701,227 | B2 * | 4/2014 | Rohr | A47C 21/026 | 5/411 |
| 9,089,224 | B1 * | 7/2015 | Baker | A47C 31/023 | |
| 2006/0179566 | A1 * | 8/2006 | James | A47C 27/081 | 5/12.1 |
| 2010/0115697 | A1 * | 5/2010 | Rohr | A47C 21/026 | 5/411 |
| 2011/0005000 | A1 * | 1/2011 | Rippe | A47C 31/10 | 5/737 |
| 2015/0366363 | A1 * | 12/2015 | Rohr | A61G 7/015 | 5/613 |

* cited by examiner

MATTRESS BUCKET RETENTION MECHANISM

CROSS-REFERENCE TO RELATED APPLICATIONS

This application is a nonprovisional of and claims priority to U.S. Provisional Patent Application No. 62/015,397, filed Jun. 21, 2014, entitled "Mattress Bucket Retention Mechanism," the contents of which is incorporated by reference in its entirety.

STATEMENT REGARDING FEDERALLY SPONSORED RESEARCH OR DEVELOPMENT

Not applicable.

TECHNICAL FIELD

Embodiments of the present invention relate to a retention mechanism for an automated furniture item, More particularly, embodiments of the present invention relate to an integrated mattress bucket retention mechanism for an adjustable bed.

BACKGROUND OF THE INVENTION

A variety of methods may be used to retain a mattress on a foundation of an adjustable bed. In some cases, metal guides and/or bars may be used to secure at least one end of a mattress with respect to articulating deckboard panels, thereby preventing shifting of the mattress during raising and lowering of the bed. However, while such methods may limit perimeter shifting of a mattress over an edge of a deckboard at an end of the bed, they do not alleviate the gaps formed between the bottom surface of the mattress and the deckboard during articulation of the adjustable bed.

BRIEF DESCRIPTION OF THE INVENTION

Embodiments of the present invention relate to an integrated mattress bucket retention mechanism for an adjustable bed. In one embodiment, the mattress bucket retention mechanism secures a mattress against articulating deckboard panels of an adjustable bed, limiting and/or minimizing the gap between the mattress and the moving deckboard panels when the mattress is articulated into different positions. In some embodiments, the mattress bucket retention mechanism may include a replaceable top surface for covering a mattress. Further, the mattress bucket retention mechanism may serve as a protective surround for the mattress, enclosing it within the interior of the mattress "bucket" and limiting exposure of the mattress to dirt and/or damage.

Accordingly, in one embodiment of the invention, a mattress bucket retention mechanism is provided. The mechanism comprises a deckboard having a deckboard edge, a mattress wrap coupled to the deckboard, said mattress wrap comprising at least one mattress wrap side panel and at least one mattress wrap top panel, a first closure mechanism coupled to the at least one mattress wrap side panel, and a second closure mechanism coupled to the at least one mattress wrap top panel, said second closure mechanism configured to couple to the first closure mechanism to at least partially secure the at least one mattress wrap top panel to the at least one mattress wrap side panel to provide an interior cavity.

In another embodiment, a mattress bucket retention device for securing a mattress on an adjustable bed is provided. The device comprises a mattress wrap coupled to at least one of a deckboard and a deckboard edge coupled to a perimeter of the deckboard, the mattress wrap comprising at least one mattress wrap side panel and at least one mattress wrap top panel, and a coupling mechanism configured to couple the at least one mattress wrap side panel to the at least one mattress wrap top panel to provide an interior cavity for securing a mattress on an adjustable bed.

In another embodiment, a mattress bucket retention mechanism is provided. The mechanism comprises a deckboard comprising a deckboard edge around a perimeter of the deckboard, a mattress wrap comprising a mattress wrap side panel and a mattress wrap top panel, and a coupling mechanism with a first portion coupled to the mattress wrap side panel and a second portion coupled to the mattress wrap top panel, wherein the mattress wrap side panel is coupled to at least a portion of the deckboard, and wherein an interior cavity for securing a mattress is formed from a space between the mattress wrap side panel, the mattress wrap top panel, and the deckboard when the first and the second portions of the coupling mechanism are at least partially releasably secured to couple the mattress wrap side panel to the mattress wrap top panel.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to an integrated mattress bucket retention mechanism for an adjustable bed. In one embodiment, the mattress bucket retention mechanism secures a mattress against articulating deckboard panels of an adjustable bed, reducing and/or minimizing the gap between the mattress and the articulated deckboard panels, particularly during movement of the panels. In some embodiments, the mattress bucket retention mechanism provides a replaceable top surface for covering a mattress. Further, the mattress bucket retention mechanism may serve as a protective surround for the mattress, enclosing it within the interior of the mattress "bucket" and limiting exposure to dirt and/or damage.

Figure 1:
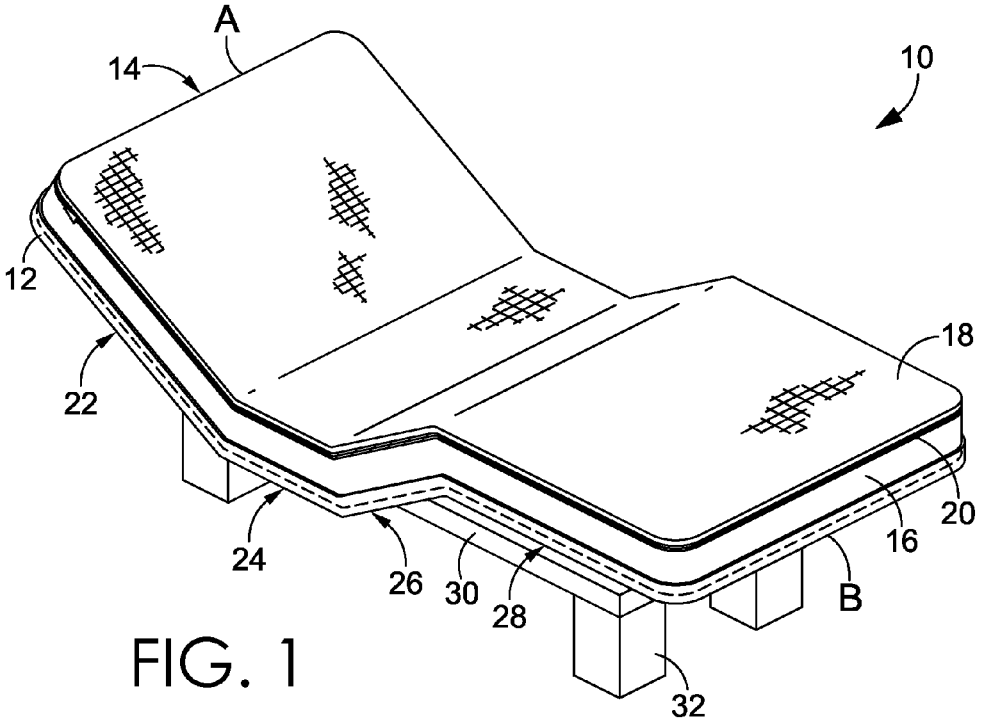
FIG. 1 is a perspective view of an exemplary adjustable bed with a mattress bucket retention mechanism, in accordance with an embodiment of the invention.

Referring now to FIG. 1, a first exemplary mattress bucket retention mechanism 10 is provided, in accordance with an embodiment of the present invention. In FIG. 1, the retention mechanism 10 includes a deckboard 12, a mattress wrap 14, a mattress wrap side panel 16, a mattress wrap top panel 18, and a closure mechanism 20 (i.e., coupling mechanism) that may be used to secure the mattress wrap top panel 18 to the mattress wrap side panel 16. In embodiments, the deckboard 12 is an articulating deckboard of an adjustable bed, which may include a first deckboard articulating portion 22, a second deckboard articulating portion 24, a third deckboard articulating portion 26, and a fourth deckboard articulating portion 28. The articulating deckboard portions 22, 24, 26, 28 may be movably or rotatably coupled together with hinges and/or other articulable connection components, and may be articulated into different positions using one or more articulating mechanisms (e.g., a hydraulic piston) coupled to the respective deckboard portions 22, 24, 26, 28. Additionally, in the exemplary embodiment depicted in FIG. 1, the articulating bed rests upon one or more rails 30 and/or legs 32 for supporting the retention mechanism 10.

Figure 2:
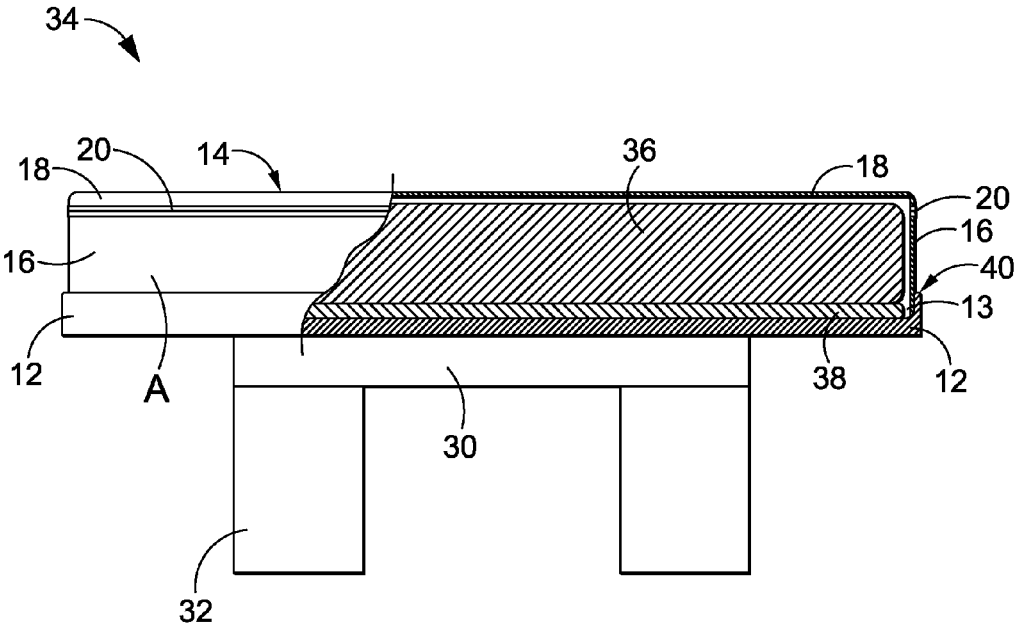
FIG. 2 is a partially cut-away side view of a mattress bucket retention mechanism, in accordance with an embodiment of the invention.

Referring to FIG. 2, a cut-away view of a second exemplary mattress bucket retention mechanism 34 is provided, in accordance with an embodiment of the present invention. In FIG. 2, a mattress 36 is positioned within an interior cavity 13 of the mattress bucket retention mechanism 34. Additionally, a foam pad 38 is positioned in the interior cavity 13 adjacent a top surface of the deckboard 12 and the bottom surface of the mattress 36, providing a cushion between the deckboard 12 and the mattress 36. In one embodiment, the interior cavity 13 is configured to secure at least a portion of a mattress 36 and/or a mattress accessory, such as a foam pad 38. In another embodiment, the interior cavity 13 only encloses a mattress 36 and a size of the interior cavity 13 corresponds to the size of the enclosed mattress 36. As such, the interior cavity 13 may be based on a size and/or range of sizes of bed components for enclosing, such as the size of the mattress 36 and/or the size of foam pad 38 (i.e., a thickness of each enclosed component).

Also shown in FIG. 2 is an interior cavity 13 of the mattress bucket retention mechanism 34 which is configured to at least partially secure the mattress 36 against the deckboard 12 to limit movement of the mattress 36 relative to the deckboard 12 when the deckboard 12 is articulated into different positions. The interior cavity 13 is generally defined as a space between the mattress wrap 14 and the deckboard 12, and/or in embodiments, a space between the mattress wrap top panel 18, the mattress wrap side panel 16, and the deckboard 12. Alternatively, in one embodiment, rather than the deckboard 12, a bottom of the interior cavity 13 may be defined by a bottom cover of the mattress wrap 14 that mates with the mattress wrap side panel 16, or may be defined by a mattress pad positioned on the deckboard 12. The interior cavity 13 limits movement of the mattress 36 both in a horizontal direction parallel to a top surface of the deckboard 12, due to the fixed edges created by the mattress wrap side panel 16 being coupled to the deckboard 12, and in a vertical direction (i.e., perpendicular to the deckboard 12) due to the mattress wrap 14 holding the mattress 36 in place against atop surface of the deckboard 12 (or a pad o bottom cover of the mattress wrap 14), to prevent lifting of the mattress 36 from the deckboard 12 when the deckboard 12 is articulated into different positions.

In one embodiment, the mattress wrap 14 may be coupled directly to the deckboard edge 40, along a perimeter of the deckboard 12, such as an outer edge of the deckboard 12 corresponding to the outer edge of the mattress 36 enclosed by the retention mechanism 10. In one embodiment, the deckboard edge 40 is a perimeter of the deckboard 12 that does not extend from a top surface of the deckboard 12. In another embodiment, the deckboard edge 40 projects from the top surface of the deckboard 12 to provide a raised edge and/or lip around the perimeter of the deckboard 12.

In embodiments of the invention, various methods may be used to couple the mattress wrap side panel 16 to the deckboard 12 and/or the deckboard edge 40. The mattress wrap side panel 16 and the deckboard 12 may be glued, stapled, stitched, braided or woven, sonically welded, and/or secured with cords, VELCRO® brand attachments, male-female connectors, or other securement mechanisms. The mattress wrap side panel 16 may be coupled directly to the deckboard 12, and/or to the deckboard edge 40 shown in FIGS. 2-4. The mattress wrap side panel 16 may be coupled or releasably secured to one or both of the deckboard 12 and/or an interior lip of the deckboard edge 40. The mattress wrap side panel 16 may be secured partially or wholly along a perimeter of the deckboard 12.

Figure 3:
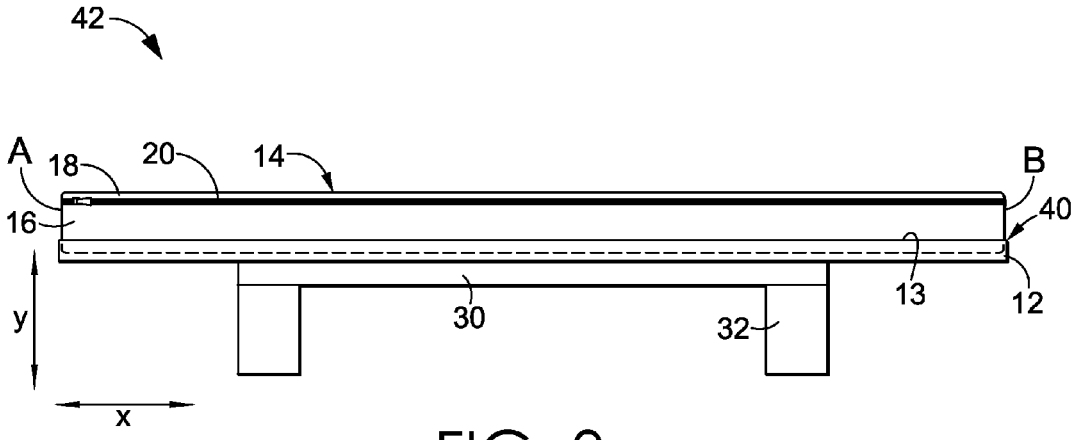
FIG. 3 is a side view of a mattress bucket retention mechanism with a deckboard in an unarticulated position, in accordance with an embodiment of the invention.

Referring to FIG. 3, a third exemplary mattress bucket retention mechanism 42, shown in a neutral unarticulated position, is provided in accordance with an embodiment of the present invention. In FIG. 3, the mattress bucket retention mechanism 42 is depicted without any articulation of the deckboard 12. As such, there is no translation of the deckboard 12 and/or the mattress 36 with respect to the x or y-axis.

The closure mechanism 20 for the mattress bucket retention mechanism 42 may include one or more zippers, VELCRO® brand attachments, glue, stitching, hook-and-loop fasteners, releasable fasteners, male/female connectors, and the like. Additionally, the closure mechanism 20 may include a first and a second portion located on the mattress wrap top and side panels, respectively, such as, for example, first and second releasably attachable portions of a zipper mechanism. Additionally, the closure mechanism 20 (which may comprise first and second matable closure mechanisms on the respective mattress wrap top panel and mattress wrap side panels) may be air-tight, water-tight, vented, or interchangeable. The closure mechanism 20 may be fully releasable such that the mattress wrap top panel 18 may be fully removed and a replacement mattress wrap top panel 18 may be used with the retention mechanism 42. The replacement mattress wrap top panel 18 may include a matching or matable portion of the closure mechanism 20 so that the replacement mattress wrap top panel 18 may be secured to the mattress wrap side panel 16. The replacement mattress wrap top panel 18 may have different performance characteristics, such as water resistance, water impermeability, vented features, antibacterial properties, and/or other properties.

Figure 4:
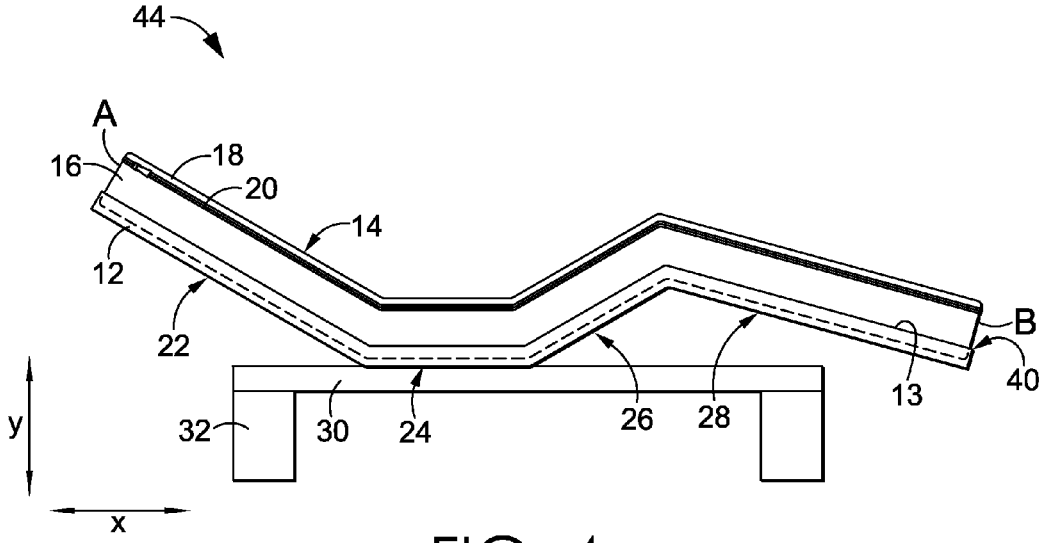
FIG. 4 is a side view of a mattress bucket retention mechanism, with a deckboard in an articulated position, in accordance with an embodiment of the invention.

Referring to FIG. 4, a fourth exemplary mattress bucket retention mechanism 44 with an articulated deckboard 12 for use with an articulating bed is provided, in accordance with an embodiment of the present invention. In FIG. 4, an adjustable bed is provided with a first end A at ahead of the bed and a second end B at a foot of the bed. At least a portion of the adjustable bed has been translated along an x-axis and along a y-axis by articulating one or more of the deckboard portions 22, 24, 26, 28 that form the deckboard 12. Further, during such articulation, the mattress 36 is retained within the interior cavity 13 which is created inside the retention mechanism 44, and is at least partially defined between the mattress wrap side panel 16, the mattress wrap top panel 18, and the deckboard 12. In some embodiments, various different types of mattress wrap top panels 18 may be utilized, such as a plasticized and/or waterproof mattress wrap top panel, or top panels that include straps, cords, releasable coupling components, and/or other securement components.

in another embodiment, the mattress wrap top panel 18 may include antibacterial and/or stain resistance properties. The mattress wrap top panel 18 and the mattress wrap side panel 16 may be attached, secured, and/or coupled using any number of connection or coupling mechanisms (zippers, male/female connectors, VELCRO® brand attachments, etc.), As shown in the embodiment depicted in FIG, 4, a zipper-type closure mechanism 20 may be used to releasably secure the mattress wrap side and top panels 16, 18 to form the interior cavity 13 between the mattress wrap top and side panels 16, 18 and the deckboard 12, which can be configured to secure the mattress 36 in position against the deckboard 12 and restrict movement of the mattress 36 away from the deckboard 12 during articulation of the adjustable bed. As such, while the mattress 36 is retained against the deckboard 12 of the retention mechanism 10, 34, 42, 44 (either directly in contact based on direct contact between the mattress 36 and the deckboard 12, or indirectly based on indirect contact through a foam pad), the mattress 36 remains protected.

At the first end A of the articulating bed depicted in FIG. 4, a user may activate one or more features of the articulating bed to raise or lower the bed into one of multiple positions. Additionally, at the second end B of the articulating bed depicted in FIG. 4, a user may activate one or more features of the articulating bed to raise or lower the bed into one of multiple positions. During such shifting of the articulating bed, including movement of the deckboard portions 22, 24, 26, and 28 with respect to each other, a mattress 36 that is removably coupled to the deckboard 12 (i.e., a mattress freely resting on the surface of the deckboard, but restrained by the retention mechanism 44) may flex and/or maneuver its position based on the corresponding movement of the deckboard 12. For example, when deckboard portion 22 at the first end A of the articulating bed is raised/lowered, the corresponding portion of the mattress 36 will raise/lower to a corresponding position with respect to the deckboard 12 in response to restricted travel from the retention mechanism 44. In further aspects, when the deckboard portion 28 at the second end B of the articulating bed is raised/lowered, the corresponding portion of the mattress 36 will raise/lower to a corresponding position with respect to the deckboard 12 in response to restricted travel from the retention mechanism 44.

In further aspects of the invention, based on contact between the mattress 36 and the deckboard 12 as secured by the retention mechanism 44, the portion of the mattress 36 at the first end A of the articulating bed remains coupled to the portion of the deckboard 12 at the first end A. Similarly, the portion of the mattress 36 at the second end B of the articulating bed remains coupled to the portion of the deckboard 12 at the second end B. Such corresponding travel between the portions of the deck board 12 and the first end A and/or the second end B of the mattress at each position along the articulating bed prevents the mattress 36 from shifting off of the deck board 12, and further provides that the mattress 36 and deckboard 12 will remain aligned at both the first end A and the second end B.

In some embodiments of the invention, the interior cavity 13 may be configured to accept multiple sizes of mattresses 36. For example, for a mattress 36 having a particular depth, the size of the foam pad 38 may be adjusted to compensate for an adjusted height gap within the interior cavity 13 of the mattress bucket retention mechanism 42 (e.g., a greater height of the foam pad 38 for a smaller depth of mattress 36). In one embodiment of the invention, the deckboard edge 40 and the mattress wrap 14 ensure that the mattress 36 remains substantially stationary, with limited gaps between the mattress 36 and the deckboard 12 during articulation of the adjustable bed. In particular, embodiments of the invention are directed to a mattress bucket retention mechanism 10, 34, 42, 44 that reduces or minimizes the gaps between the bottom surface of the mattress 36 and the top surface of the deckboard 12 and/or the foam pad 38.

From the foregoing, it will be seen that this invention is one well adapted to attain all the ends and objects hereinabove set forth together with other advantages, which are obvious and inherent structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and non-limiting.

The invention claimed is:

1. A mattress bucket retention mechanism, the mechanism comprising:

a deckboard having a plurality of articulating deckboard sections and a deckboard edge;

a mattress wrap coupled to the deckboard around the deckboard edge, the mattress wrap comprising at least one mattress wrap side panel and at least one mattress wrap top panel, the at least one mattress wrap side panel coupled to the deckboard and the at least one mattress wrap top panel coupled to the at least one mattress wrap side panel;

a first closure mechanism coupled to the at least one mattress wrap side panel; and a second closure mechanism coupled to the at least one mattress wrap top panel, the second closure mechanism configured to couple to the first closure mechanism to at least partially secure the at least one mattress wrap top panel to the at least one mattress wrap side panel to provide an interior cavity between the mattress wrap and the deckboard, wherein the interior cavity is configured to receive a mattress, wherein the mattress wrap is configured to restrict movement of the mattress within the interior cavity during articulation of the plurality of deckboard sections when the mattress is received in the interior cavity, wherein the mattress extends over the plurality of articulating deckboard sections and over a plurality of hinges separating the plurality of articulating deckboard sections when received in the interior cavity, and wherein the mattress maintains a constant thickness over the plurality of articulating deckboard sections and the plurality of hinges when received in the interior cavity.

2. The mechanism of claim 1, wherein the deckboard edge comprises an extended edge perpendicular to a top surface of the deckboard, and wherein the deckboard edge is configured to surround at least a portion of a perimeter of the deckboard.

3. The mechanism of claim 2, wherein the at least one mattress wrap side panel includes a bottom edge coupled to at least one of the deckboard edge and the top surface of the deckboard.

4. The mechanism of claim 2, wherein the mattress wrap is configured to secure the mattress extending across the plurality of articulating deckboard sections and the plurality of hinges to restrict movement of the mattress away from the top surface of the deckboard.

5. The mechanism of claim 1, wherein the interior cavity further includes the at least one mattress wrap top panel secured to the at least one mattress wrap side panel, the mattress wrap side panel positioned around the perimeter of the mattress.

6. The mechanism of claim 1, further comprising a foam pad positioned adjacent a top surface of the deckboard.

7. A mattress bucket retention device for securing a mattress on an adjustable bed, the device comprising:

a mattress wrap coupled to at least one of a deckboard and a deckboard edge, the mattress wrap comprising at least one mattress wrap side panel coupled to the at least one of the deckboard and the deckboard edge and at least one mattress wrap top panel coupled to the at least one mattress wrap side panel; and a coupling mechanism configured to couple the at least one mattress wrap side panel to the at least one mattress wrap top panel to provide an interior cavity, wherein the deckboard has a plurality of articulating deckboard sections and a plurality of hinges separating the plurality of articulating deckboard sections, wherein the interior cavity is configured to receive a mattress extending across the plurality of articulating deckboard sections and across the plurality of hinges, the mattress maintaining a constant thickness over the plurality of articulating deckboard sections and the plurality of hinges when received in the interior cavity, and wherein the mattress wrap is configured to restrict movement of the mattress extending across the plurality of articulating deckboard sections and the plurality of hinges when the mattress is within the interior cavity during articulation of the plurality of articulating deckboard sections.

8. The device of claim 7, further comprising a foam pad positioned on a top surface of the deckboard.

9. The device of claim 7, wherein the deckboard edge extends upward in a direction perpendicular to a top surface of the deckboard.

10. The device of claim 7, wherein the at least one mattress wrap side panel comprises a first material, and the at least one mattress wrap top panel comprises a second material.

11. The device of claim 7, wherein the coupling mechanism is a zipper, wherein a first side of the zipper is coupled to the at least one mattress wrap side panel and a second side of the zipper is coupled to the at least one mattress wrap top panel, and wherein the first side of the zipper and the second side of the zipper are releasable attachable to each other.

12. The device of claim 11, wherein the at least one mattress wrap top panel is interchangeable with a replacement mattress wrap top panel that includes the second side of the zipper.

13. The device of claim 7, wherein the interior cavity is formed between the at least one mattress wrap side panel, the at least one mattress wrap top panel, and the deckboard when the mattress wrap side panel and the mattress wrap top panel are at least partially coupled to each other with the coupling mechanism.

14. The device of claim 7, wherein upon articulating the plurality of articulating deckboard sections, a first end of the mattress received within the interior cavity is restricted from movement relative to a corresponding first deckboard section and remains coupled to the first deckboard section, and a second end of the mattress received within the interior cavity is restricted from movement relative to a corresponding second deckboard section and remains coupled to the second deckboard section, and wherein the movement restriction comprises restricting movement of the mattress away from a top surface of the deckboard.

15. A mattress bucket retention mechanism, the mechanism comprising:

a deckboard comprising a plurality of articulating deckboard sections, a plurality of hinges separating the plurality of articulating deckboard sections, and a deckboard edge extending around a perimeter of the deckboard;

a mattress wrap comprising a mattress wrap side panel and a mattress wrap top panel; and a coupling mechanism with a first portion coupled to the mattress wrap side panel and a second portion coupled to the mattress wrap top panel, wherein the mattress wrap side panel is coupled around the perimeter of the deckboard, wherein the mattress wrap top panel is configured to be releasably coupled to the mattress wrap side panel with the coupling mechanism, wherein an interior cavity is formed from a space between the mattress wrap side panel, the mattress wrap top panel, and the deckboard when the first and the second portions of the coupling mechanism are at least partially releasably secured to each other, the interior cavity configured to receive a mattress extending across the plurality of articulating deckboard sections and the plurality of hinges, the mattress maintaining a constant thickness over the plurality of articulating deckboard sections and the plurality of hinges, and wherein the mattress wrap is configured to restrict movement of the mattress extending across the plurality of articulating deckboard sections and the plurality of hinges within the interior cavity during articulation of the plurality of deckboard sections.

16. The mechanism of claim 15, further comprising a foam pad positioned on a top surface of the deckboard within the deckboard edge.

17. The mechanism of claim 16, wherein the mattress wrap top panel is fully separable from the mattress wrap side panel, and wherein when the first and the second portions of the coupling mechanism are secured to each other, a mattress space is defined between a top of the foam pad and the mattress wrap top panel, wherein the mattress space may be varied by varying a thickness of the foam pad.

18. The mechanism of claim 17, wherein during articulation of the plurality of articulating deckboard sections, the mattress wrap restricts movement of the mattress away from a top surface of the deckboard.

19. The mechanism of claim 18, wherein during articulation of the plurality of articulating deckboard sections, the mattress is secured by the mattress wrap with respect to the deckboard edge to limit movement of the mattress parallel to the top surface of the deckboard.

* * * * *